US010343422B2

(12) United States Patent
Sadakuni et al.

(10) Patent No.: US 10,343,422 B2
(45) Date of Patent: Jul. 9, 2019

(54) RECORDING APPARATUS

(71) Applicant: SEIKO EPSON CORPORATION, Tokyo (JP)

(72) Inventors: Kei Sadakuni, Shiojiri (JP); Satoshi Chiba, Suwa (JP); Nobuyuki Mizushima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/896,497

(22) Filed: Feb. 14, 2018

(65) Prior Publication Data

US 2018/0236785 A1 Aug. 23, 2018

(30) Foreign Application Priority Data

Feb. 17, 2017 (JP) ..... 2017-027621

(51) Int. Cl.

| | |
|---|---|
| ***B41J 11/00*** | (2006.01) |
| ***B41J 29/17*** | (2006.01) |
| ***B41J 15/04*** | (2006.01) |
| ***B41J 29/38*** | (2006.01) |

(52) U.S. Cl.

CPC ..... *B41J 11/007* (2013.01); *B41J 15/048* (2013.01); *B41J 29/17* (2013.01); *B41J 29/38* (2013.01); *B65H 2601/324* (2013.01)

(58) Field of Classification Search

CPC ..... B41J 11/007; B41J 15/048; B41J 29/38; B41J 29/17; B65H 2601/324; G03G 2215/00556; G03G 2215/00565; G03G 2215/00675; G03G 2215/00679

See application file for complete search history.

(56) References Cited

U.S. PATENT DOCUMENTS

2016/0257137 A1 9/2016 Segawa

FOREIGN PATENT DOCUMENTS

| | | |
|---|---|---|
| JP | 2005-300916 A | 10/2005 |
| JP | 2012-088569 A | 5/2012 |
| JP | 2016-159605 A | 9/2016 |

*Primary Examiner* — Kristal Feggins

(74) *Attorney, Agent, or Firm* — Workman Nydegger

(57) ABSTRACT

A recording apparatus includes a belt conveyor unit that can be switched between a first state in which at least a portion of the belt outer surface of a conveyor belt is located at a recording position at which a line head performs recording and a second state in which the belt outer surface is located more distant than the recording position from the line head. The recording apparatus also includes a wiping device that is in contact with the belt outer surface and wipes the belt outer surface. The belt conveyor unit is switched from the second state to the first state after carrying out of a preliminary operation in which the conveyor belt is moved over a predetermined distance in a reverse direction opposite to a normal direction in which the conveyor belt transports a sheet.

9 Claims, 11 Drawing Sheets

SECOND STATE

SECOND STATE
(AFTER PRELIMINARY OPERATION)

FIRST STATE

FIRST STATE
(NORMAL ROTATION STARTED)

SECOND STATE

SECOND STATE
(AFTER PRELIMINARY OPERATION)

SECOND STATE
(NORMAL ROTATION STARTED)

RECORDING APPARATUS

INCORPORATED BY REFERENCE

The entire disclosure of Japanese Patent Application No. 2017-027621, filed Feb. 17, 2017 is expressly incorporated by reference herein.

BACKGROUND

1. Technical Field

The present disclosure relates to a recording apparatus that performs recording onto a medium.

2. Related Art

Some recording apparatuses, typical examples of which are printers, may include a recording unit and a belt conveyor device. The recording unit performs recording onto a sheet of paper, which is an example of a medium. The belt conveyor device has a conveyor belt that adheres the sheet thereto and transports the sheet to a recording region in which the recording unit performs recording. One type of such recording apparatuses includes a wiping device (for example, a cleaning blade, etc.) that is in contact with the surface of the conveyor belt and wipes the surface in order to clean debris, such as ink and toner, attached to the surface of the conveyor belt that supports the sheet (for example, JP-A-2005-300916).

Ink, toner, and paper debris containing ink and toner, which are attached to the tip of the wiping device, may coagulate if a recording apparatus having the wiping device is not used for a long time. Debris on the surface of the conveyor belt are normally wiped or scraped off by the wiping device. However, if the belt conveyor device starts moving while a coagulation body made of coagulated ink, toner, or the like adheres firmly to the conveyor belt near the tip of the wiping device, the coagulation body may pass the wiping device without being removed. The coagulation body does not simply pass the wiping device but may push against the wiping device and cause the orientation of the wiping device to change. This may cause the wiping device to be unable to perform wiping appropriately.

To address this problem, JP-A-2005-300916 discloses a configuration in which the belt conveyor device starts rotating the conveyor belt in the sheet transport direction (hereinafter referred to as "normal direction") after the belt conveyor device rotates the belt a predetermined distance in the reverse direction, which is opposite to the normal direction. The coagulation body attached to the tip of the wiping device is thereby detached from the tip. Movement of the belt is subsequently started. The coagulation body is brought into contact with the wiping device with momentum. Thus, the coagulation body can be wiped off by the wiping device.

JP-A-2016-159605 discloses that in order to facilitate maintenance of the belt conveyor device, the belt conveyor device (i.e., the transport unit 50 according to JP-A-2016-159605) is formed so as to move between a first position at which the recording unit performs recording and a second position at which the belt conveyor device is more distant than the first position from the recording unit.

In the transport unit 50, described in JP-A-2016-159605, which moves between the first position and the second position, when the transport unit 50 moves from the second position to the first position, the conveyor belt 21 may be caused to rotate unintentionally in conjunction with the movement of the transport unit 50, despite the conveyor belt 21 not being driven by a drive source. Moreover, in the case that the wiping device is disposed in the transport unit 50, if the conveyor belt stops rotating at the second position during maintenance, etc., and if the stop period is long, the coagulation body may adhere to the tip of the wiping device. When the conveyor belt 21 is caused to move in conjunction with the movement of the transport unit 50 from the second position to the first position, there may be a problem where the coagulation body passes the wiping device and causes a change in the orientation of the wiping device is to occur.

SUMMARY

An advantage of some aspects of the disclosure is that appropriate cleaning of a conveyor belt is performed by a wiping device in a belt conveyor apparatus that can be switched between a state in which the belt conveyor apparatus is located at a recording position and a state in which the belt conveyor apparatus is more distant than the recording position from the recording unit.

A recording apparatus according to one aspect of the disclosure includes a recording unit that performs recording by ejecting liquid onto a medium; a belt conveyor unit including an upstream-side roller, a downstream-side roller, and an endless conveyor belt that extends around the upstream-side roller and the downstream-side roller and has a belt outer surface, the belt conveyor unit transporting the medium so as to adhere the medium to the belt outer surface, the belt conveyor unit being switchable between a first state in which at least a portion of the belt outer surface is located at a recording position at which the recording unit performs recording and a second state in which the belt outer surface is located more distant than the recording position from the recording unit; and a wiping device that is in contact with the belt outer surface and wipes the belt outer surface. In the recording apparatus, the belt conveyor unit is switched from the second state to the first state after carrying out of a preliminary operation in which the conveyor belt is moved over a predetermined distance in a direction opposite to a normal direction in which the conveyor belt transports the medium.

If the belt conveyor unit remains stopped in the second state for a long time, a coagulation body may be formed of coagulation of, for example, liquid discharged from the recording unit near the tip of the wiping device. According to this configuration, the belt conveyor unit is switched from the second state to the first state after carrying out of a preliminary operation in which the conveyor belt is moved over a predetermined distance in a direction opposite to a normal direction in which the conveyor belt transports the medium. For example, the conveyor belt is caused to move unintentionally when the belt conveyor unit is switched from the second state to the first state, which may lead to a problem in which a coagulation body hits the wiping device and causes the orientation of the wiping device to change. With this configuration, the likelihood of the problem occurring can be reduced. Thus, appropriate wiping of the conveyor belt can be performed by the wiping device.

It is preferable that in the recording apparatus, the belt conveyor unit be formed so as to move rotatably about a pivot while a rotation shaft of the upstream-side roller serves as the pivot so that the belt conveyor unit may be switched between the first state and the second state.

According to this configuration, the belt conveyor unit is formed so as to move rotatably about the rotation shaft of the upstream-side roller so that the belt conveyor unit may be switched between the first state and the second state. When the belt conveyor unit is switched from the second state to the first state, the conveyor belt may be caused to move unintentionally in the normal direction in which the medium is transported. In this case, when the coagulation body adhere to the tip of the wiping device, the movement of the conveyor belt in the normal direction causes the coagulation body to push against the wiping device and cause the orientation of the wiping device to change. With this configuration, the likelihood of this problem occurring can be reduced, and appropriate wiping of the conveyor belt can be performed by the wiping device.

It is preferable that in the recording apparatus, the belt conveyor unit be switched from the second state to the first state after the conveyor belt starts moving in the normal direction contiguously after the preliminary operation is carried out.

According to this configuration, the belt conveyor unit is switched from the second state to the first state after the conveyor belt starts moving in the normal direction contiguously after the preliminary operation is carried out. Thus, advantageous effects similar to those of previous configurations can be obtained.

It is preferable that in the recording apparatus, the conveyor belt start moving in the normal direction after the belt conveyor unit is switched from the second state to the first state.

According to this configuration, the conveyor belt starts moving in the normal direction after the belt conveyor unit is switched from the second state to the first state. Thus, advantageous effects similar to those of previous configurations can be thereby obtained.

It is preferable that the recording apparatus further include a charging device that charges the conveyor belt, wherein the charging device charges the conveyor belt when the conveyor belt moves in the normal direction. With this configuration, the medium can adhere to the conveyor belt more effectively.

It is preferable that in the recording apparatus, the preliminary operation be omitted in the case that a stop period of the conveyor belt is less than a predetermined value when the belt conveyor unit is switched from the second state to the first state.

If the conveyor belt stops for a long time, a coagulation body of coagulated ink or the like may be formed at the tip of the wiping device. However, if the stop period is short, ink or the like does not coagulate. According to this configuration, the preliminary operation be omitted in the case that the stop period of the conveyor belt is less than a predetermined value when the belt conveyor unit is switched from the second state to the first state. Omitting the preliminary operation where the preliminary operation is not necessary can reduce the time required for switching the state of belt conveyor unit.

It is preferable that the recording apparatus further include a drive source that drives the belt conveyor unit and a load detection device that detects a load applied to the drive source. In the recording apparatus, it is also preferable that the conveyor belt be moved over a distance determined in advance in the normal direction before carrying out of the preliminary operation, and that the preliminary operation be omitted in the case that the load detected by the load detection device when the conveyor belt is moved is lower than a predetermined value.

When the conveyor belt of the belt conveyor unit is moved in the normal direction over the distance determined in advance, it can be determined that a coagulation body is not present or small if the load detected by the load detection device is less than the predetermined value. With this configuration, the time required for switching the state can be reduced by omitting the preliminary operation. Note that the "distance determined in advance" as used herein is a distance over which a coagulation body moves such that the coagulation body hits the wiping device but does not change its orientation while the conveyor belt moves in the normal direction. The distance is determined by the material, the dimensions, etc., of the wiping device and can be obtained through calculations and experiments.

A recording apparatus according to another aspect of the disclosure includes a recording unit that performs recording by ejecting liquid onto a medium; a belt conveyor unit including an upstream-side drive roller, a downstream-side idler roller, and an endless conveyor belt that extends around the upstream-side drive roller and the downstream-side idler roller and has a belt outer surface, the belt conveyor unit transporting the medium so as to adhere the medium to the belt outer surface, the belt conveyor unit being switchable between a first state in which at least a portion of the belt outer surface is located at a recording position at which the recording unit performs recording and a second state in which the belt outer surface is located more distant than the recording position from the recording unit; and a wiping device disposed in the belt conveyor unit, the wiping device being in contact with the belt outer surface and wiping the belt outer surface. In the recording apparatus, the belt conveyor unit is formed so as to move rotatably about a pivot while a drive shaft of the upstream-side drive roller serves as the pivot so that the belt conveyor unit may be switched between the first state and the second state, and the belt conveyor unit is switched from the second state to the first state while the upstream-side drive roller rotates freely relative to the drive shaft.

The belt conveyor unit is formed so as to move rotatably about a pivot while a drive shaft of the upstream-side drive roller serves as the pivot so that the belt conveyor unit may be switched between the first state and the second state. In this case, when the belt conveyor unit is switched from the second state to the first state, the conveyor belt may be caused to move in the normal direction in which the medium is transported. According to this configuration, the belt conveyor unit is switched from the second state to the first state while the upstream-side drive roller rotates freely relative to the drive shaft. In the state switching, this reduces the likelihood of the conveyor belt being moved in the normal direction in which the medium is transported. Accordingly, this can reduce the likelihood of such a problem in which the coagulation body attached to the tip of the wiping device causes the orientation of the wiping device to change when the belt conveyor unit is switched from the second state to the first state.

It is preferable that in the above recording apparatus, when the belt conveyor unit is switched from the second state to the first state, power supplied to a drive source that drives the upstream-side drive roller be switched off.

According to this configuration, when the belt conveyor unit is switched from the second state to the first state, power supplied to a drive source that drives the upstream-side drive roller is switched off. This causes the upstream-side drive roller to be able to rotate freely relative to the drive shaft.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

EXAMPLE 1

Figure 1:
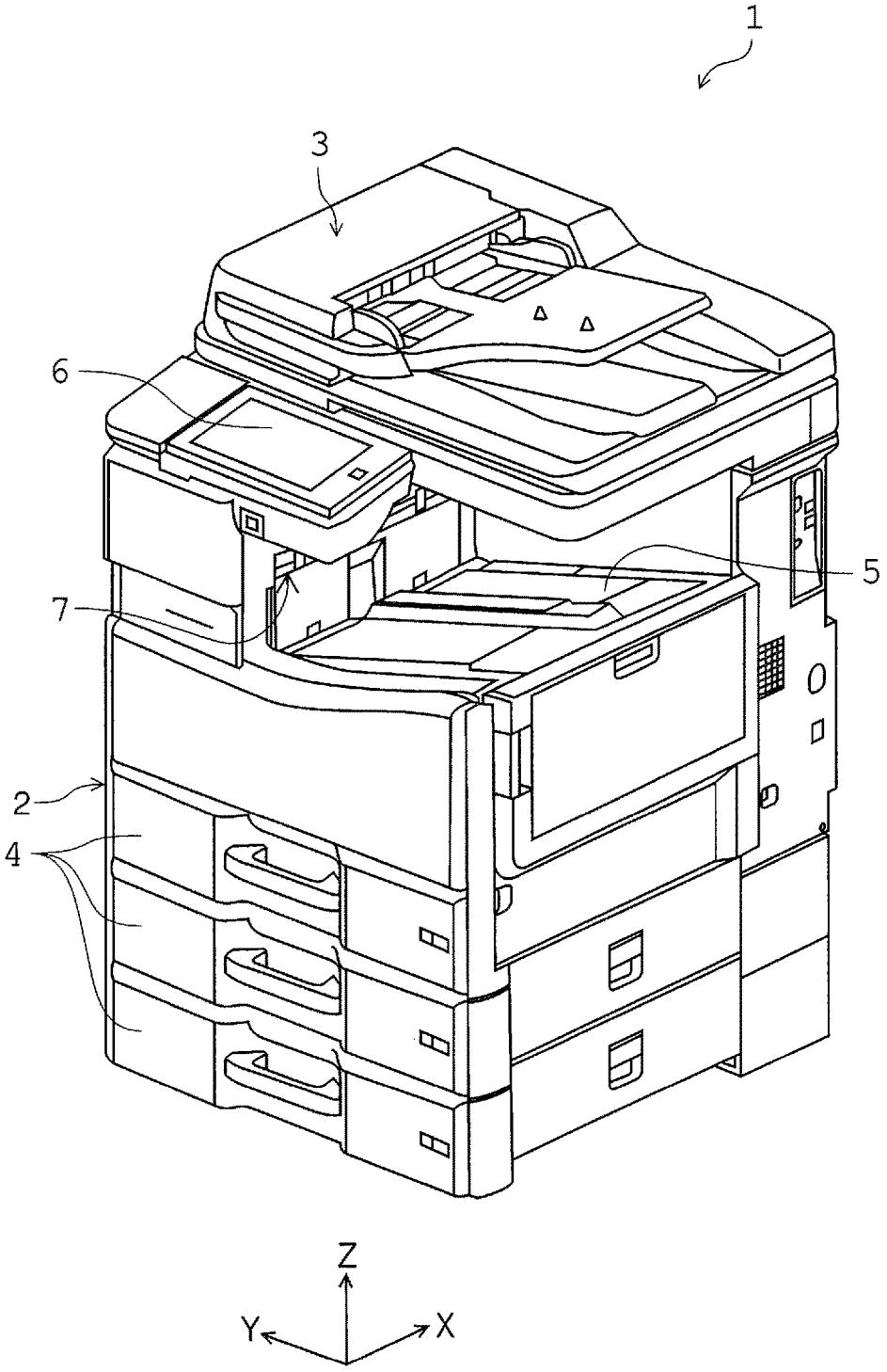
FIG. 1 is a perspective view illustrating the exterior of a printer according to one example of the disclosure.
Figure 2:
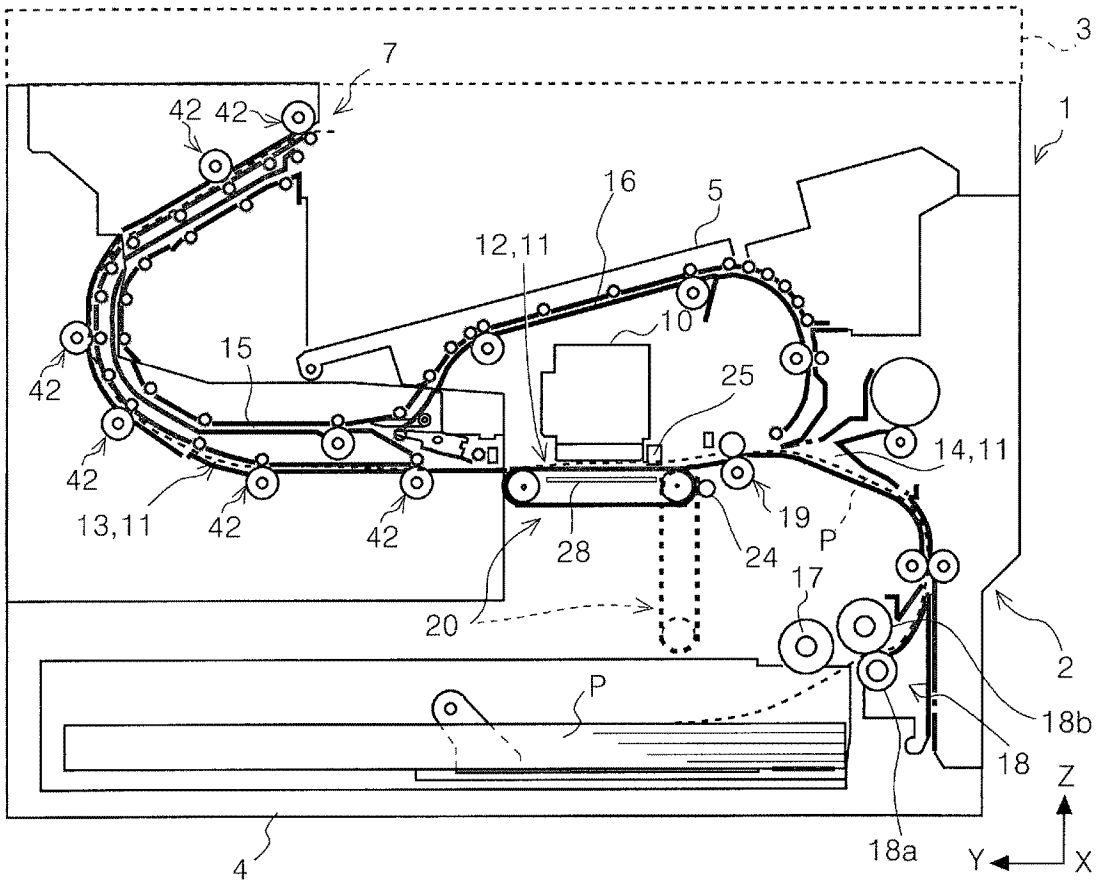
FIG. 2 is a view schematically illustrating a transport path in the printer for sheets of paper.
Figure 3:
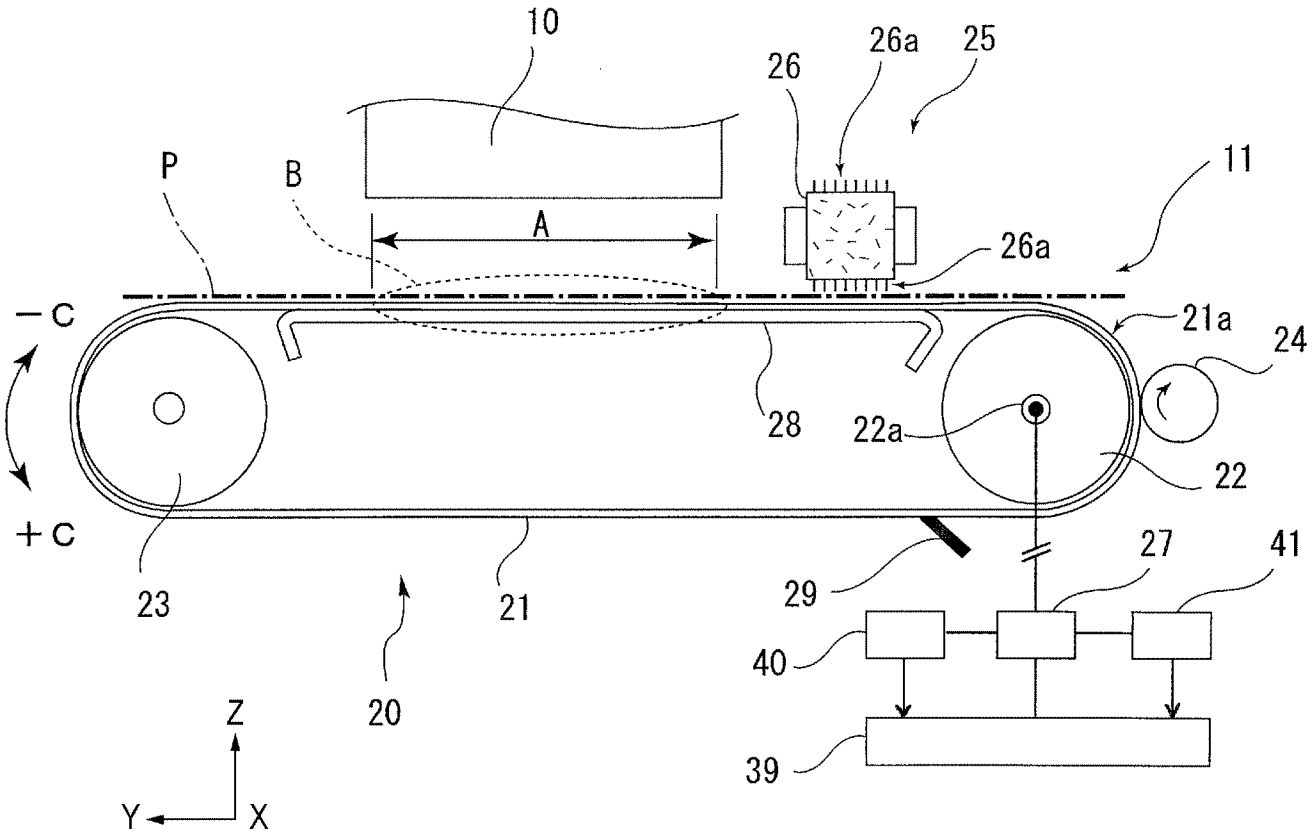
FIG. 3 is a side view schematically illustrating a belt conveyor unit.
Figure 4A:
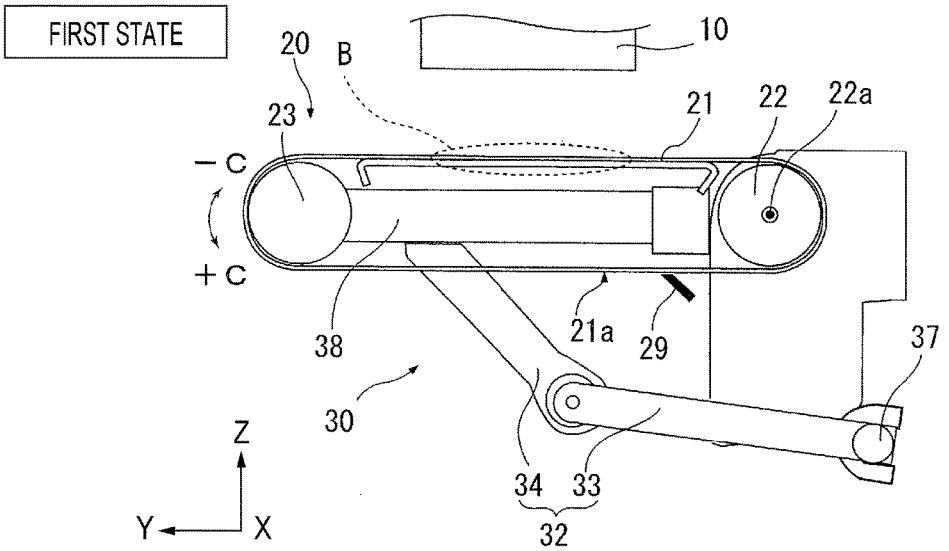
FIG. 4A is a view illustrating state-switching of the belt conveyor unit.
Figure 4B:
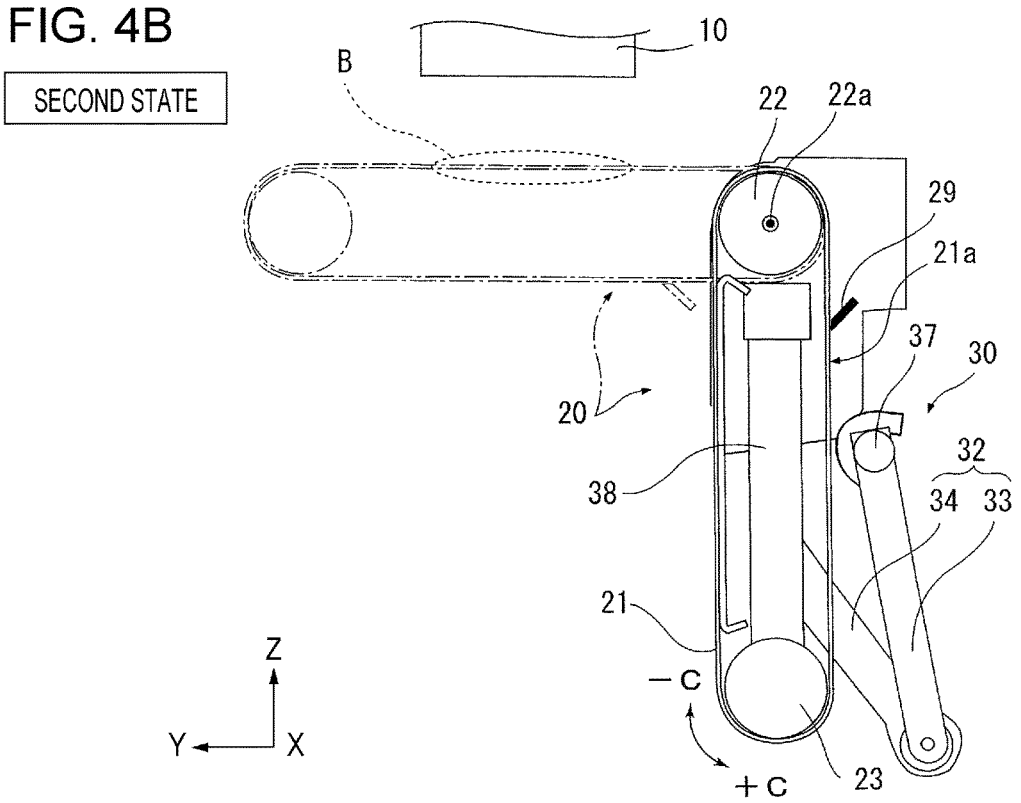
FIG. 4B is another view illustrating state-switching of the belt conveyor unit.
Figure 5:
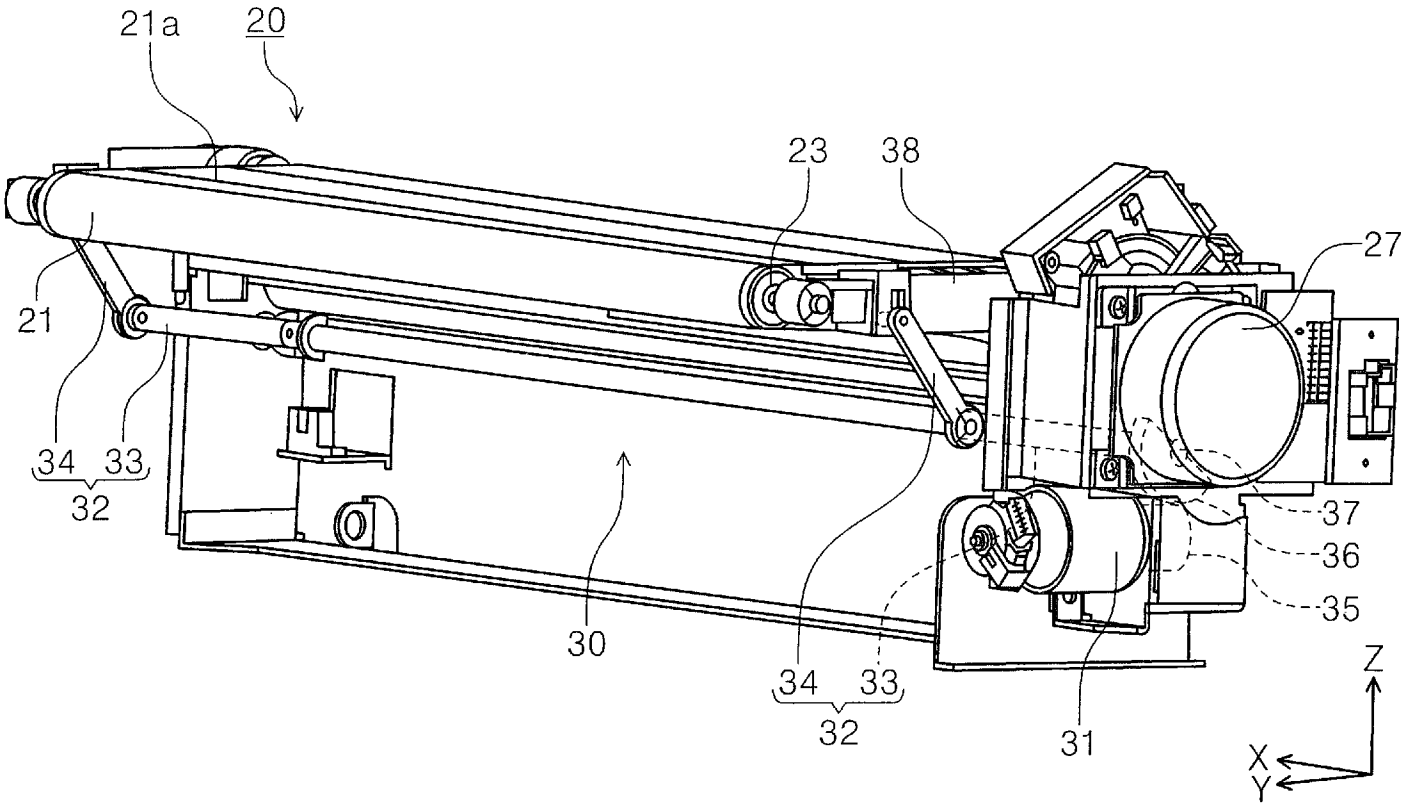
FIG. 5 is a perspective view illustrating the belt conveyor unit in a first state and a state-switching mechanism.
Figure 6:
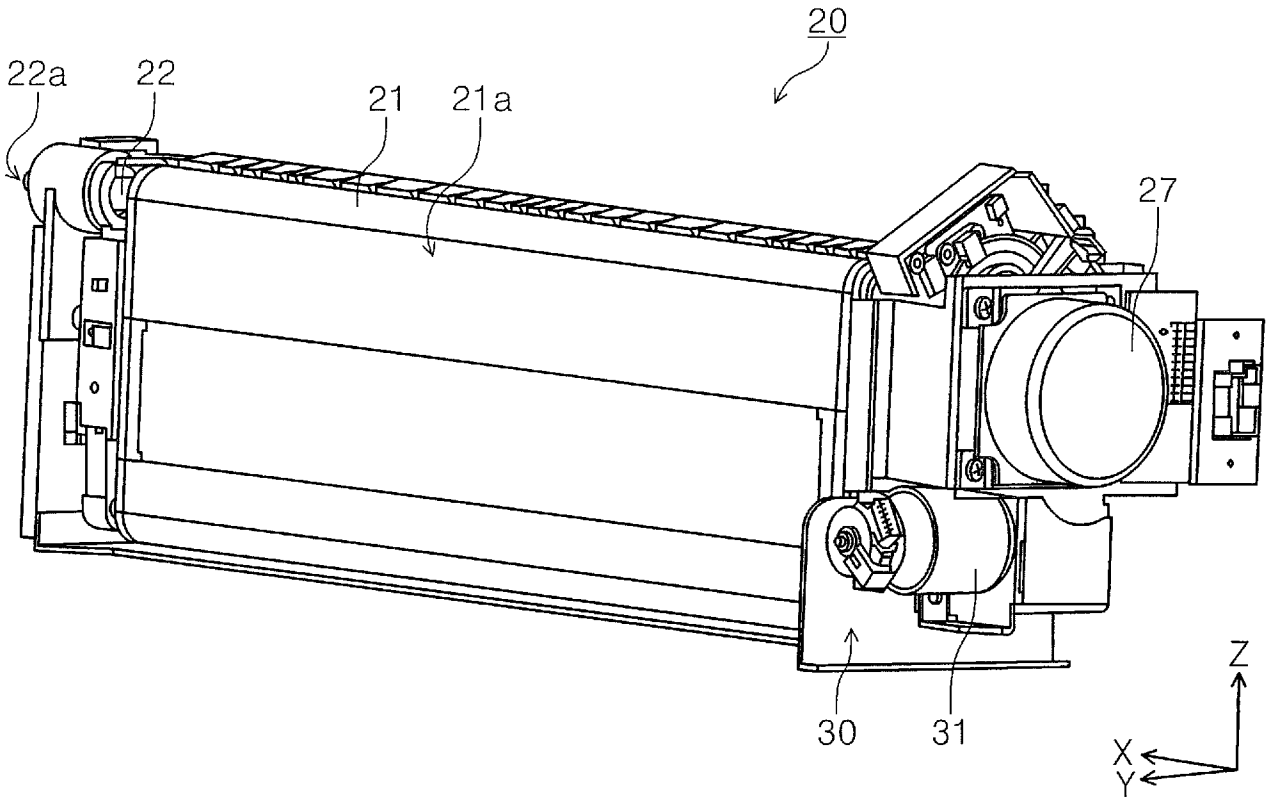
FIG. 6 is a perspective view illustrating the belt conveyor unit in a second state and the state-switching mechanism.
Figure 7:
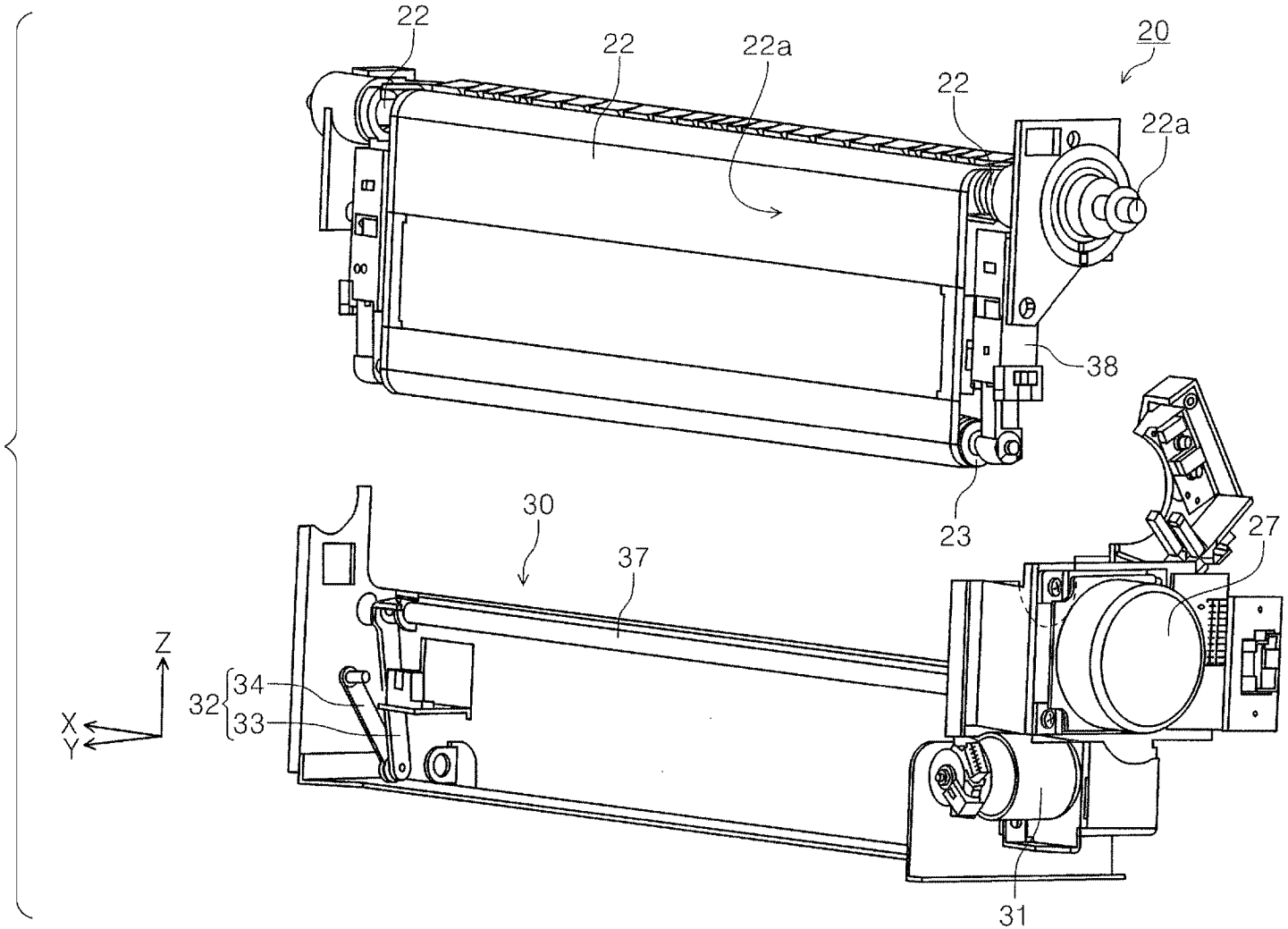
FIG. 7 is a view illustrating a state in which the belt conveyor unit and the state-switching mechanism in FIG. 6 are separated from each other.
Figure 8A:
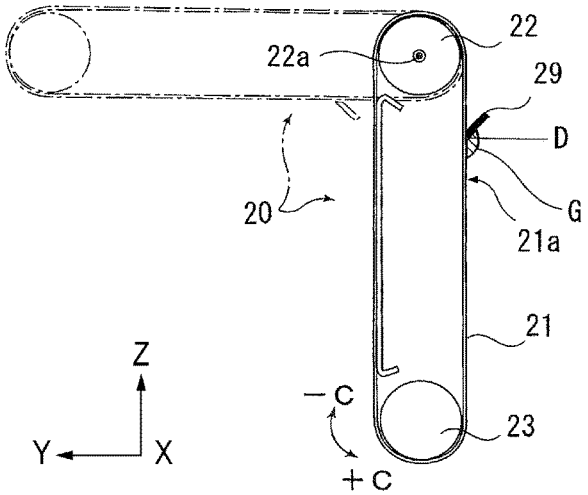
FIG. 8A is a view illustrating an example of state-switching of the belt conveyor unit from the second state to the first state.
Figure 9A:
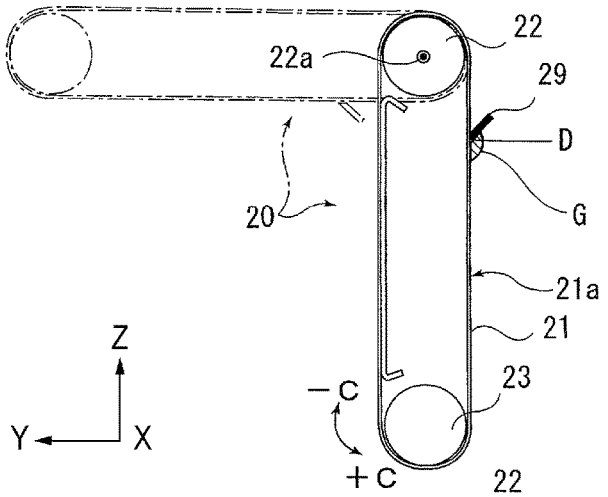
FIG. 9A is a view illustrating another example of the state-switching of the belt conveyor unit from the second state to the first state.
Figure 9B:
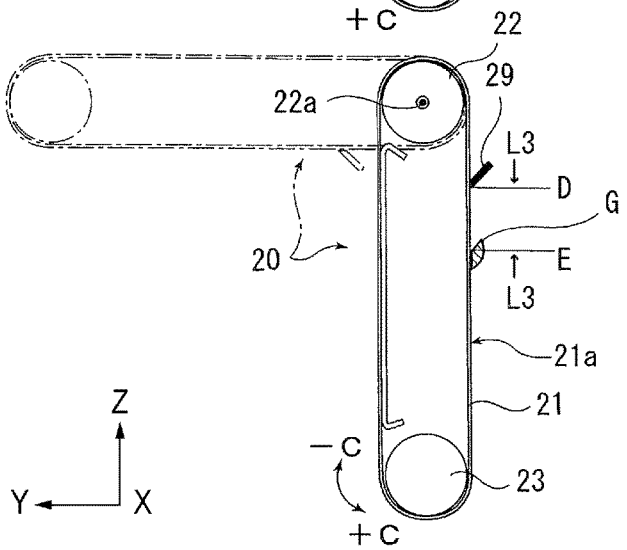
FIG. 9B is another view illustrating another example of the state-switching of the belt conveyor unit from the second state to the first state, in which the belt conveyor unit is in a state transitioned from the state in FIG. 9A.
Figure 9C:
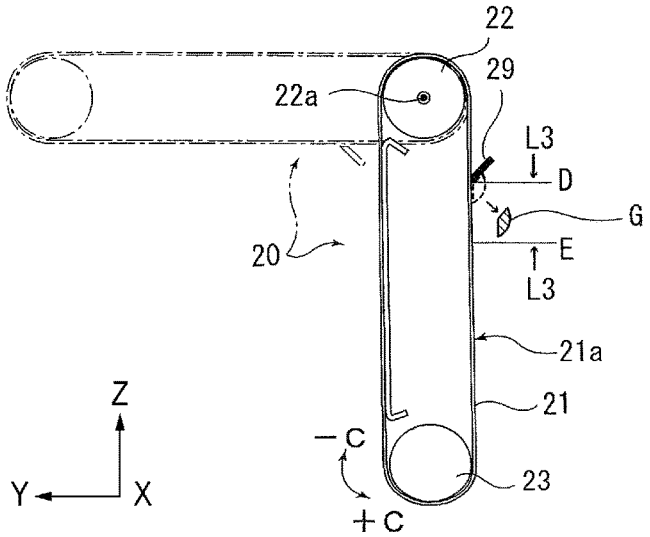
FIG. 9C is another view illustrating another example of the state-switching of the belt conveyor unit from the second state to the first state, in which the belt conveyor unit is in a state transitioned from the state in FIG. 9B.
Figure 10A:
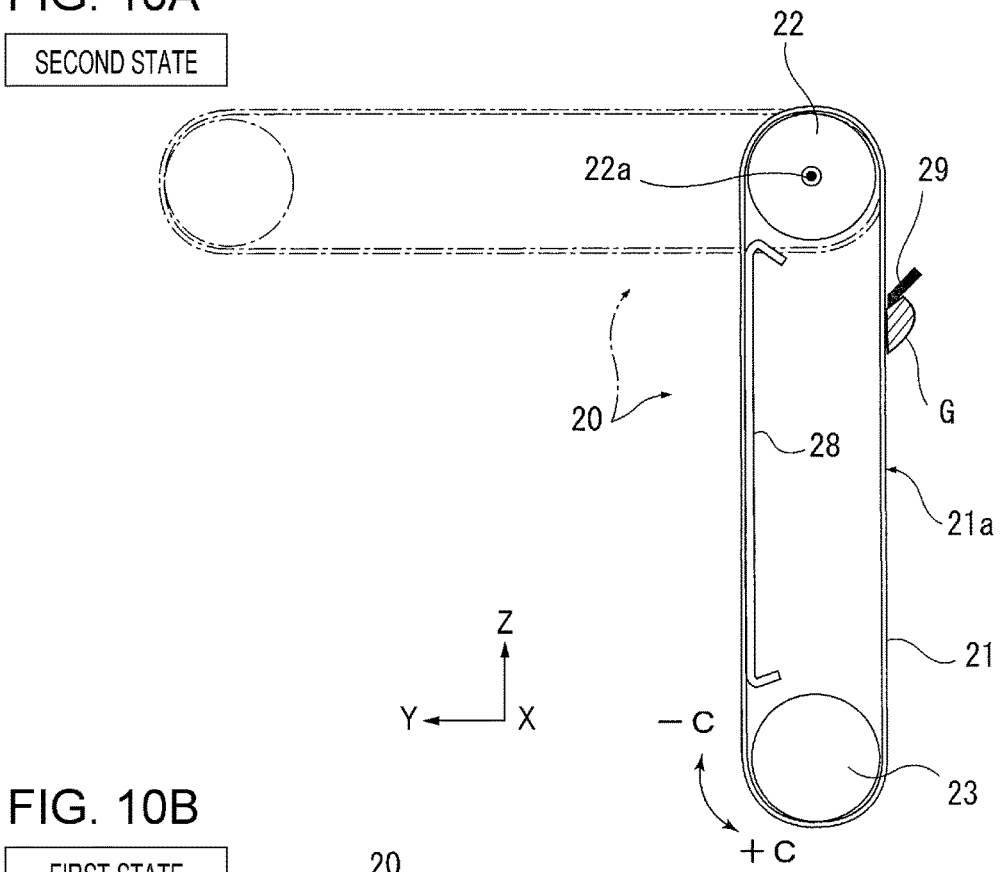
FIG. 10A is a view illustrating a case in which the second state of the belt conveyor unit is switched to the first state without carrying out a preliminary operation.
Figure 10B:
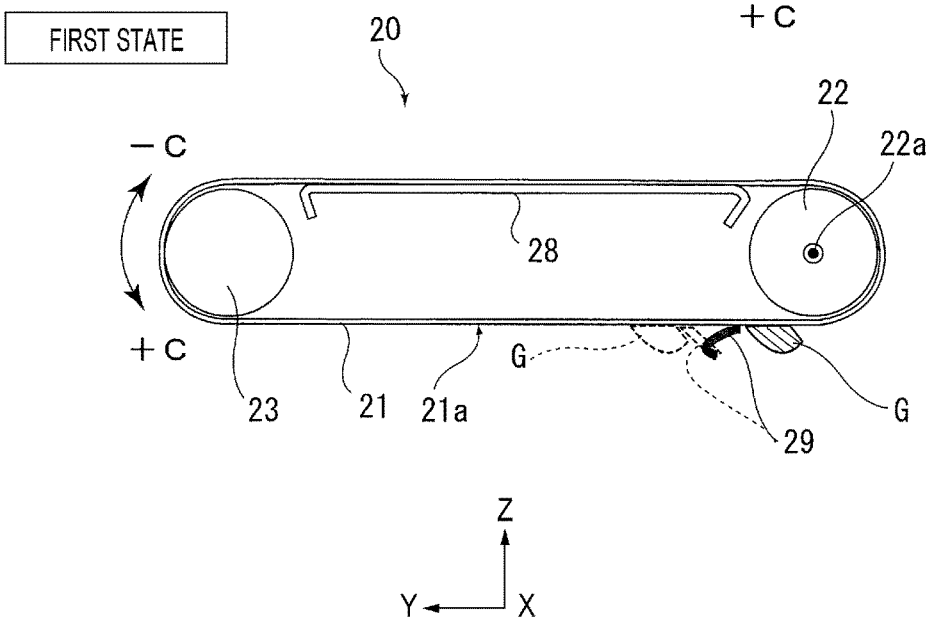
FIG. 10B is another view illustrating a case in which the second state of the belt conveyor unit is switched to the first state without carrying out a preliminary operation.

First, a recording apparatus according to an example of the disclosure will be outlined. An example of the recording apparatus according to the Example 1 is an ink jet printer 1 (also referred to simply as a "printer 1" below). FIG. 1 is a perspective view illustrating the exterior of the printer 1 according to one example of the disclosure. FIG. 2 is a view schematically illustrating a transport path in the printer 1 for sheets of paper. FIG. 3 is a side view schematically illustrating a belt conveyor unit. FIG. 4A and FIG. 4B are views illustrating state-switching of the belt conveyor unit. FIG. 5 is a perspective view illustrating the belt conveyor unit in a first state and a state-switching mechanism. FIG. 6 is a perspective view illustrating the belt conveyor unit in a second state and the state-switching mechanism. FIG. 7 is a view illustrating a state in which the belt conveyor unit and the state-switching mechanism in FIG. 6 are separated from each other. FIG. 8A to FIG. 8D are views sequentially illustrating an example of state-switching of the belt conveyor unit from the second state to the first state. FIG. 9A to FIG. 9C are views sequentially illustrating another example of the state-switching of the belt conveyor unit from the second state to the first state. FIG. 10A and FIG. 10B are views illustrating a case in which the second state of the belt conveyor unit is switched to the first state of the belt conveyor unit without a preliminary operation being performed.

In the X-Y-Z coordinate system shown in each drawing, the X direction represents the width direction of a medium transported along a transport path of the recording apparatus, the Y direction represents the transport direction of the medium, and the Z direction represents the height direction of the apparatus. In each drawing, the −X direction is the direction from the rear side to the front side of the apparatus, and the +X direction is the opposite direction.

Overview of Printer

The printer 1 will be described with reference to FIG. 1. The printer 1 is formed as a multifunction printer including an apparatus body 2 and a scanner unit 3. The apparatus body 2 includes a plurality of paper cassettes 4 that accommodate sheets of paper P (see FIG. 2), which are also referred to as "media". Each of the paper cassettes 4 is detachably mounted into the apparatus body 2 from the front side thereof (from the side in the −X direction in FIG. 1). In this specification, sheets of paper P (sheets P) include, for example, sheets of plain paper, thick paper, or photo paper.

In the height direction (Z direction) of the apparatus body 2, a discharging portion 7 and a media placement portion 5 are provided between the scanner unit 3 and the paper cassette 4. The discharging portion 7 discharges sheets P on which a line head 10 (FIG. 2) that serves as a recording unit has performed recording by ejecting ink, which is an example of liquid. The sheets P discharged from the discharging portion 7 are placed on the media placement portion 5. An operation unit 6 is disposed close to the front side of the apparatus body 2. The operation unit 6 includes a display unit, such as a liquid crystal panel. Instructions for recording and image scanning can be input to the printer 1 through the operation unit 6.

Transport Path of Printer

Next, a transport path 11 for sheets P in the printer 1 will be described with reference to FIG. 2. The printer 1 according to Example 1 includes a transport path 11 for sheets P. The transport path 11 includes a feed path 14, a straight path 12, and a face-down discharge path 13. A sheet P is picked up from a paper cassette 4 and fed through the feed path 14. The feed path 14 is connected to the straight path 12 that includes a recording region A (see FIG. 3) where the line head 10 performs recording. A sheet P is transported from the straight path 12 to the discharging portion 7 via the face-down discharge path 13. Next, transport of sheets P from the paper cassettes 4 to the discharging portion 7 will be described.

Note that the printer 1 also includes a switch-back path 15 and an inversion path 16. The switch-back path 15 branches from the straight path 12 at a position downstream of the line head 10. The inversion path 16, which is connected to the switch-back path 15, inverts the top and bottom (first face and second face) of a sheet P and returns the inverted sheet P to the straight path 12. Thus, the printer 1 is formed so as to be able to perform recording first onto the first face of a sheet P and consecutively onto the second face, in other words, to be able to perform double-sided recording. Further description of the inversion of a sheet P by using the switch-back path 15 and the inversion path 16 is omitted here.

A feed roller 17 and a separation roller pair 18 that separates one sheet from plural sheets of paper are provided in this order along the feed path 14 in the transport direction of sheets P. The feed roller 17 is rotationally driven by a drive source (not shown). The separation roller pair 18, referred to as "retard rollers", includes a drive roller 18*a* and an idler roller 18*b*. The drive roller 18*a* sends a sheet P toward the straight path 12, which will be described below. The idler roller 18*b* separates a sheet P from other sheets by nipping the sheet P in collaboration with the drive roller 18*a*.

As illustrated in FIG. 2, a plurality of sheets P accommodated in the paper cassettes 4 are picked up by the feed roller 17 one by one starting from the topmost sheet P, and the sheet P is transported downstream in the transport direction. At this time, there may be a case in which the topmost sheet P and subsequent sheets P are transported simultaneously. In this case, the separation roller pair 18 separates the topmost sheet P from the subsequent sheets P so that only the topmost sheet P is transported to the feed path 14.

A resist roller 19 is disposed downstream of the separation roller pair 18 in the transport direction. In Example 1, the feed path 14 is connected to the straight path 12 at the position of the resist roller 19. The straight path 12 is a path that extends straight. The resist roller 19, a belt conveyor unit 20, a static-eliminating unit 25, and the line head 10 are disposed along the straight path 12. The straight path 12 is a path that passes the recording region A (FIG. 3) of the line head 10 and extends both upstream and downstream of the line head 10.

In the present embodiment, the belt conveyor unit 20 is disposed in a region opposing the head surface of the line head 10. The belt conveyor unit 20 supports the bottom side of a sheet P, which is opposite to the recording side of the sheet P. A configuration of the belt conveyor unit 20 will be described in detail below.

The line head 10 is formed so as to perform recording by ejecting ink onto the recording side of a sheet P when the sheet P is transported to a position on the belt conveyor unit 20 that opposes the line head 10. The line head 10 is a recording head in which the ink ejecting nozzles are provided so as to cover the whole width of a sheet P, and the recording head is formed so as to be able to perform recording over the whole width of the sheet P without moving in the medium width direction. Note that although the printer 1 according to Example 1 includes the line head 10, the printer 1 may instead include a serial-type recording head that is mounted on a carriage and performs recording by ejecting liquid onto a medium while moving reciprocally in a direction intersecting the medium transport direction.

A sheet P transported along the straight path 12 is subsequently sent to the face-down discharge path 13. The face-down discharge path 13 is a transport path 11 having a curved portion to which the straight path 12 is connected. The sheet P, on which the line head 10 has performed recording, is transported along the face-down discharge path 13 so that the sheet P is discharged from the discharging portion 7 with the recording side facing downward. The sheet P entering the face-down discharge path 13 is transported by a plurality of advancing roller pairs 42, discharged from the discharging portion 7, and placed on the media placement portion 5 with the recording side facing down.

Belt Conveyor Unit

Next, the belt conveyor unit 20 that transports sheets P will be described with reference mainly to FIG. 3. The belt conveyor unit 20 according to the embodiment includes an endless conveyor belt 21, which causes a sheet P to adhere to a belt outer surface 21*a* thereof, and at least two rollers, in other words, an upstream-side drive roller 22 (upstream-side roller) and a downstream-side idler roller 23 (downstream-side roller), around which the conveyor belt 21 extends. The downstream-side idler roller 23 is located downstream of the upstream-side drive roller 22 in the medium transport direction (i.e., +Y direction in FIG. 3).

In the belt conveyor unit 20, the upstream-side drive roller 22 is rotationally driven by a first drive source 27, such as a motor (also see FIG. 6). The upstream-side drive roller 22 subsequently drives the conveyor belt 21 so as to transport a sheet P downstream in the medium transport direction. The downstream-side idler roller 23 is passively rotated by the conveyor belt 21 that is driven by the rotation of the upstream-side drive roller 22. Note that reference numeral 22*a* in FIG. 3 denotes a drive shaft (otherwise referred to as "rotation shaft") of the upstream-side drive roller 22.

The first drive source 27 is configured to be able to rotate normally or in reverse so as to cause the conveyor belt 21 to move in the normal direction for transporting a sheet P (+C direction of the bidirectional arrow in FIG. 3) or in the reverse direction (−C direction of the bidirectional arrow in FIG. 3) that is opposite to the normal direction. A control device 39 (FIG. 3) controls the actuation of the first drive source 27.

The belt conveyor unit 20 is formed so as to be switchable between a first state (FIG. 3 and FIG. 4A) in which at least a portion of the belt outer surface 21*a* is located at a recording position B (FIG. 3) where the line head 10 performs recording and a second state (FIG. 4B) in which the belt outer surface 21*a* is more distant than the recording position B from the line head 10. Note that the belt conveyor unit 20 in the first state is indicated by the dash-dot lines in FIG. 4B. Also note that when the belt conveyor unit 20 in the second state is described with reference to other figures, the belt conveyor unit 20 in the first state may also be indicated by dash-dot lines.

The belt conveyor unit 20 includes a wiping device 29 that is in contact with the belt outer surface 21*a* and wipes the belt outer surface 21*a*. In the embodiment, for example, a blade-shaped material made of an elastic material, such as resin or rubber, may be used as the wiping device 29. The wiping device 29 is disposed upstream of a charging roller 24 (to be described below) in the traveling direction of the conveyor belt 21. As illustrated in FIG. 3, one end of the wiping device 29 is in contact with the belt outer surface 21*a* at a position further upstream of the conveyor belt 21 in the traveling direction than the other end of the wiping device 29. In other words, the wiping device 29 is disposed such that the wiping device 29 is in contact with the belt outer surface 21*a* in an inclined manner and scrapes, while the conveyor belt 21 moves, debris (paper debris, ink, or the like) that are attached to the belt outer surface 21*a*. Note that the wiping device 29 is fixed relative to the belt conveyor unit 20 and thereby moves with the wiping device 29 when the belt conveyor unit 20 changes the state. The wiping device 29 and a state-switching mechanism 30 (FIG. 5) of the belt conveyor unit 20 will be further described below.

In the embodiment, the conveyor belt 21 is a belt that causes a sheet P to electrostatically adhere to the belt outer surface 21*a* and transports the sheet P. The belt conveyor unit 20 has a charging roller 24, which is an example of a charging device that charges the conveyor belt 21, and a static-eliminating unit 25, which eliminates electric charges from the surface of the sheet P transported by the conveyor belt 21.

As illustrated in FIG. 3, the charging roller 24 is disposed upstream of the static-eliminating unit 25 in the traveling direction of the conveyor belt 21. In addition, the charging roller 24 is disposed at a level below the transport path 11 and at a position opposing the upstream-side drive roller 22. The charging roller 24 is in contact with the belt outer surface 21*a*. When rotation of the upstream-side drive roller 22 and the downstream-side idler roller 23 drives the conveyor belt 21, the belt outer surface 21*a*, which is charged after the charging roller 24 comes into contact with the belt outer surface 21*a*, becomes a path-forming surface that constitutes the transport path 11. This configuration improves the adherence of a sheet P to the conveyor belt 21 that constitutes the transport path 11 so that the sheet P can adhere to the conveyor belt 21 more effectively.

In the embodiment, the static-eliminating unit 25 (FIG. 3) is disposed so as to extend across a sheet P in the width direction thereof (X direction) and have an endless static-eliminating belt 26 that travels in the width direction. The static-eliminating belt 26 has a brush 26*a* (FIG. 3) protruding from the outer surface thereof. A portion of the static-eliminating belt 26 that opposes the sheet P on the conveyor belt 21 moves in the X direction, which is the width direction of medium. Electric charges on the surface of the sheet P are removed by pressing the brush 26*a* of the static-eliminating belt 26 against the sheet P. Removing electric charges from the surface of the sheet P improves the adherence of the sheet P to the conveyor belt 21.

The belt conveyor device 20 also has a backing plate 28 disposed between the upstream-side drive roller 22 and the downstream-side idler roller 23. The backing plate 28 supports at least part of the inner surface of the conveyor belt 21.

State-switching Mechanism of Belt Conveyor Unit

Next, the state-switching mechanism 30 of the belt conveyor unit 20 will be described with reference to FIGS. 4A, 4B to FIG. 7. The state-switching mechanism 30 (see FIGS. 4A, 4B to FIG. 7) is able to switch the belt conveyor unit 20 between the first state (FIG. 4A), in which a portion of the conveyor belt 21 is located at the recording position B at which the line head 10 performs recording, and the second state, in which the belt conveyor unit 20 is more distant than the recording position B from the line head 10.

In the embodiment, the state-switching mechanism 30 is formed so as to pivotably move the belt conveyor unit 20 while the drive shaft 22*a* (see FIGS. 4A, 4B and FIG. 7) of the upstream-side drive roller 22 serves as the pivot, thereby switching the belt conveyor unit 20 between the first state and the second state. More specifically, the state-switching mechanism 30 includes a link member 32 that is operated by actuation of a second drive source 31 (FIG. 5), such as a motor. The link member 32 further includes a first link plate 33 and a second link plate 34.

The link member 32, which is operated by actuation of the second drive source 31, causes the belt conveyor unit 20 to rotate from the first state (FIG. 4A and FIG. 5) to the second state in which the belt outer surface 21*a* is away from the line head 10. The belt conveyor unit 20 is rotated such that the side of the conveyor unit 20 that is close to the downstream-side idler roller 23 moves in the −Z direction about the upstream-side drive roller 22 as the pivot. When the belt conveyor unit 20 is in the second state, the line head 10 is in a state of not performing recording onto a sheet P. At this time, in order, for example, to maintain recording performance of the line head 10, a cap (not shown) can be placed, in the +Z direction, onto the line head 10 that is in the state of not performing recording.

As illustrated in FIG. 5, a worm gear 35 is fixed to the motor shaft (not shown) of the second drive source 31 and engages a worm wheel 36, which is fixed to an end of a shaft 37. The shaft 37 rotates in conjunction with rotation of the worm wheel 36. Respective ends of two first link plates 33 are attached to the shaft 37 at positions distant from each other in the X direction. The other ends of the two first link plates 33 are pivotably attached to respective ends of two second link plates 34. The other ends of the two second link plates 34 are attached to a base body 38 that rotatably supports the upstream-side drive roller 22 and the downstream-side idler roller 23.

When actuation of the second drive source 31 causes the shaft 37 to rotate, for example, clockwise when viewed in the +X direction, the first link plate 33 and the second link plate 34 are collapsed such that both link plates come closer to each other, as illustrated in FIG. 4B and FIG. 6. The belt conveyor unit 20 thereby assumes the second state. On the other hand, when actuation of the second drive source 31 causes the shaft 37 to rotate counterclockwise when viewed in the +X direction, the first link plate 33 and the second link plate 34 expand so that the belt conveyor unit 20 assumes the first state, as illustrated in FIG. 4A and FIG. 5. Note that the movement of the belt conveyor unit 20 when changing from the first state to the second state (state change from state in FIG. 4A to state in FIG. 4B) may be referred to as a "reversing action" of the belt conveyor unit 20, and the movement of the belt conveyor unit 20 when changing from the second state to the first state (state change from state in FIG. 4B to state in FIG. 4A) may be referred to as an "advancing action" of the belt conveyor unit 20.

State-switching of Belt Conveyor Unit from Second State to First State

In the configuration (such as the state-switching mechanism 30) in which the belt conveyor unit 20 is pivotably moved while the drive shaft 22*a* of the upstream-side drive roller 22 serves as the pivot and is switched between the first state and the second state, when the belt conveyor unit 20 is switched from the second state to the first state (i.e., advancing action), the conveyor belt 21 may be caused to move in the normal direction +C for transporting a sheet P. The movement of the conveyor belt 21 in the normal direction +C in conjunction with the advancing action tends to occur particularly in the case that the control device 39 controls the first drive source 27 and restricts free rotation of the upstream-side drive roller 22.

When the belt conveyor unit 20 assumes the second state, the line head 10 does not perform recording, as described above. In this case, the belt conveyor unit 20 can stop transporting a sheet P. In other words, the movement of the conveyor belt 21 is stopped. When the printer 1 is not used and the belt conveyor unit 20 is stopped in the second state for a long time, coagulation of ink discharged from the line head 10 or coagulation of a mixture of ink and paper debris or the like may form a coagulation body G (see FIG. 10A) on a tip portion of the wiping device 29.

As illustrated in FIG. 10A, the belt conveyor unit 20 is switched to the first state by performing the advancing action of the belt conveyor unit 20 while a coagulation body G formed in the second state remains on a tip portion of the wiping device 29 of the belt conveyor unit 20. At this time, the conveyor belt 21 is caused to move in the normal direction +C in conjunction with the advancing action. As a result, the coagulation body G hits, or passes, the wiping device 29 as illustrated in FIG. 10B, which may displace the tip of the wiping device 29 to a different orientation. Note that the positions of the coagulation body G and the wiping device 29 shown in FIG. 10A are indicated by dotted lines in FIG. 10B.

Figure 8B:
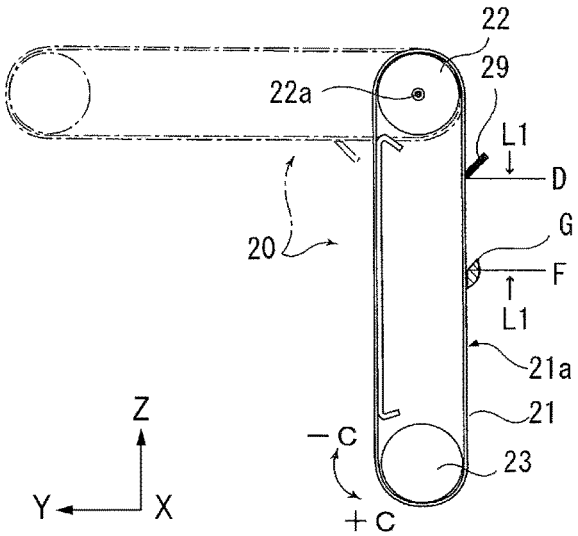
FIG. 8B is another view illustrating an example of state-switching of the belt conveyor unit from the second state to the first state, in which the belt conveyor unit is in a state transitioned from the state in FIG. 8A.
Figure 8C:
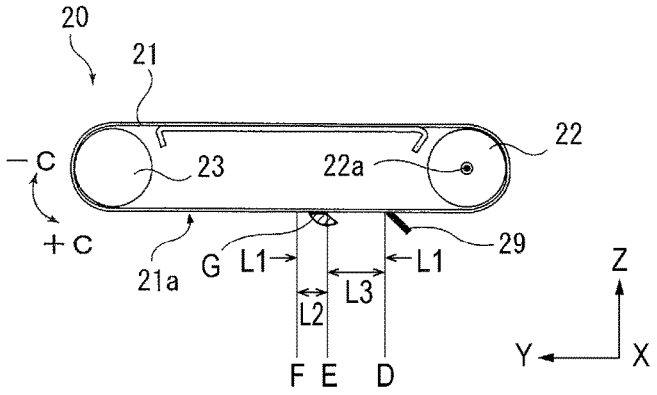
FIG. 8C is another view illustrating an example of state-switching of the belt conveyor unit from the second state to the first state, in which the belt conveyor unit is in a state transitioned from the state in FIG. 8B.

In order to avoid or suppress a problem in which the tip orientation of the wiping device 29 is changed in conjunction with the advancing action of the belt conveyor unit 20, the advancing action, in other words, the state-switching of the belt conveyor unit 20 from the second state (FIG. 8A) to the first state (FIG. 8C), is performed after carrying out a preliminary operation (FIG. 8B). In the preliminary operation, the conveyor belt 21 is moved over a predetermined distance in the reverse direction −C, which is opposite to the normal direction +C for transporting a sheet P. An example of this configuration will be described below with reference to FIG. 8A to FIG. 8D.

FIG. 8A illustrates a state in which the belt conveyor unit 20 stays in the second state and a coagulation body G, which is formed of coagulated ink or an ink and paper debris mixture and the like, is attached to the tip of the wiping device 29. The position of the coagulation body G in this state is denoted by position D. From this state, the preliminary operation is carried out before the belt conveyor unit 20 is switched to the first state. In other words, the conveyor belt 21 is moved over a predetermined distance L1 in the reverse direction −C (FIG. 8B). It is preferable that the predetermined distance L1 be not less than the sum of a distance L2 and a distance L3, where the distance L2 (FIG. 8C) is the distance of movement of the conveyor belt 21 in conjunction with the advancing action of the belt conveyor unit 20, and the distance L3 (FIG. 8D) is the distance over which the conveyor belt 21 can provide sufficient momentum for the coagulation body G to be scraped off by the wiping device 29. Note that after the preliminary operation, the coagulation body G is located at position F.

Figure 8D:
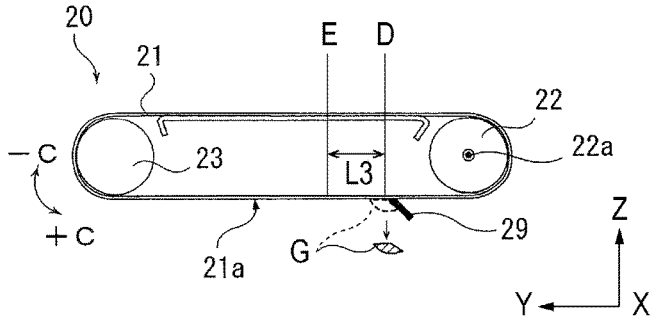
FIG. 8D is another view illustrating an example of state-switching of the belt conveyor unit from the second state to the first state, in which the belt conveyor unit is in a state transitioned from the state in FIG. 8C.

After the preliminary operation (FIG. 8B), the belt conveyor unit 20 is switched from the second state to the first state (i.e., advancing action). The belt conveyor unit 20 thereby assumes a state illustrated in FIG. 8C. At this time, the conveyor belt 21 is caused to move in the normal direction +C in conjunction with the advancing action, and the coagulation body G is thereby moved in the normal direction +C over a distance of L2 to position E. When the conveyor belt 21 starts moving in the normal direction +C while the belt conveyor unit 20 is in the first state and the coagulation body G is located in position E, the coagulation body G hits the wiping device 29 and is scraped from the belt outer surface 21*a* (FIG. 8D). The moving speed of the conveyor belt 21 in the normal direction +C while the coagulation body G is located in position E is desirably set larger than that of the conveyor belt 21 when it is caused to move in the normal direction +C in conjunction with the advancing action of belt conveyor unit 20.

In summary, the movement of the conveyor belt 21 in the +C direction caused by the advancing action of the belt conveyor unit 20 causes the coagulation body G to hit the wiping device 29 and change the tip orientation of the wiping device 29. The likelihood of such a problem occurring can be reduced by carrying out the preliminary operation before the state-switching of the belt conveyor unit 20 from the second state to the first state (i.e., advancing action). Thus, appropriate wiping of the conveyor belt 21 can be performed by the wiping device 29.

Another Example of State-switching of Belt Conveyor Unit from Second State to First State.

As illustrated in FIG. 9A to FIG. 9C, the advancing action of the belt conveyor unit 20 can be performed after the conveyor belt 21 moves in the normal direction +C after the preliminary operation. In other words, the state-switching of the belt conveyor unit 20 from the second state to the first state (i.e., advancing action) can be performed after the belt conveyor unit 20 starts moving in the normal direction +C contiguously after the preliminary operation is carried out. Note that FIG. 9A to FIG. 9C illustrate a procedure that is carried out until the conveyor belt 21 starts moving in the normal direction +C and before the advancing action is started.

FIG. 9A illustrates the same state as in FIG. 8A. From this state, the preliminary operation is carried out before the belt conveyor unit 20 is switched to the first state. In other words, the conveyor belt 21 is moved over a predetermined distance L3 in the reverse direction −C (FIG. 9B). The distance L3 is preferably equal to or more than a distance in which the conveyor belt 21, when starts moving in the normal direction +C, provides sufficient momentum for a coagulation body G to be scraped off by the wiping device 29. After the preliminary operation, the coagulation body G is located at position E.

When the belt conveyor unit 20 that assumes the second state starts moving the conveyor belt 21 in the normal direction +C after the preliminary operation, the coagulation body G hits the wiping device 29 and is scraped from the belt outer surface 21*a* (FIG. 9C). Consequently, the coagulation body G is removed from the tip of the wiping device 29. When the belt conveyor unit 20 is switched to the first state thereafter, the tip of the wiping device 29 is not likely to change its orientation. Thus, after the state-switching, the wiping device 29 can perform appropriate wiping of the conveyor belt 21.

MODIFICATION EXAMPLE 1

In state-switching of the belt conveyor unit 20 from the second state to the first state, the preliminary operation can be omitted in the case that the stop period of the conveyor belt 21 is less than a predetermined value. The printer 1 includes a measurement device 40 that measures the operating time of the first drive source 27. The data of operating time of the first drive source 27 measured by the measurement device 40 (FIG. 3) is sent to the control device 39. In accordance with the data, the control device 39 controls actuation of the first drive source 27.

If the conveyor belt 21 stops for a long time, a coagulation body G may be formed at the tip of the wiping device 29. However, if the stop period is short, ink does not coagulate. Thus, when the belt conveyor unit 20 is switched from the second state to the first state, the preliminary operation can be omitted in the case that the stop period of the conveyor belt 21 measured by the measurement device 40 is less than a predetermined value (a period in which a coagulation body G is not likely to form). Omitting the preliminary operation where the preliminary operation is not necessary can reduce the time required for switching the state of belt conveyor unit 20.

MODIFICATION EXAMPLE 2

Alternatively, the printer 1 can be equipped with a load detection device 41 (FIG. 3) that detects the load applied to the first drive source 27. Before carrying out the preliminary operation, in other words, in the state illustrated in FIG. 8A and FIG. 9A, the conveyor belt 21 is moved in the normal direction +C over a distance determined in advance. If the load detected by the load detection device 41 is lower than the predetermined value, the preliminary operation can be omitted. Note that the "distance determined in advance" as used herein is a distance over which a coagulation body G moves such that the coagulation body G hits the wiping device 29 but does not change its orientation while the conveyor belt 21 moves in the normal direction +C when, for example, the conveyor belt 21 is in the state in FIG. 8A. The distance is governed by the material, the dimensions, etc., of the wiping device 29 and can be obtained through calculations and experiments.

When the conveyor belt 21 of the belt conveyor unit 20 is moved in the normal direction +C over the distance determined in advance, the control device 39 determines that a coagulation body G attached to the wiping device 29 is not present or small if the load detected by the load detection device 41 is less than the predetermined value. If the coagulation body G attached to the wiping device 29 is not present or small, the preliminary operation is not necessary. Thus, the preliminary operation is not performed, which can reduce the time required for switching the state of belt conveyor unit 20.

MODIFICATION EXAMPLE 3

The belt conveyor unit 20 may be formed such that the upstream-side drive roller 22 rotates freely relative to the drive shaft 22*a* when the belt conveyor unit 20 is switched from the second state to the first state (state-switching from FIG. 4B to FIG. 4A).

To cause the upstream-side drive roller 22 to rotate freely relative to the drive shaft 22*a*, the power supplied to the first drive source 27 that drives the upstream-side drive roller 22 can be switched off. In other words, the control device 39 cuts off the current supplied to the first drive source 27 when the belt conveyor unit 20 is switched from the second state to the first state.

As described above, in the configuration according to the embodiment in which the belt conveyor unit 20 is pivotably moved while the drive shaft 22*a* of the upstream-side drive roller 22 serves as the pivot and is switched between the first state and the second state, when the belt conveyor unit 20 is switched from the second state to the first state (i.e., advancing action), the conveyor belt 21 may be caused to move in the normal direction +C. However, if the advancing action of the belt conveyor unit 20 is performed while the upstream-side drive roller 22 can rotate freely relative to the drive shaft 22*a*, the likelihood of the conveyor belt 21 being moved in the normal direction +C during the advancing action can be reduced. Thus, when the advancing action is performed, the likelihood of a problem in which, for example, a coagulation body G attached to the tip of the wiping device 29 causes the orientation of the wiping device 29 to change can be reduced.

Note that when the belt conveyor unit 20 is switched from the second state to the first state while the upstream-side drive roller 22 can rotate freely relative to the drive shaft 22*a*, the preliminary operation may be carried out either before or after the state-switching. If the preliminary operation is carried out before the state-switching (as illustrated in FIG. 8A to FIG. 8D), the predetermined distance over which the conveyor belt 21 is moved in the reverse direction −C in the preliminary operation can be such that the distance L2 (FIG. 8C), which is the length of movement of the conveyor belt 21 in conjunction with the state-switching of the belt conveyor unit 20, is not taken into account. In this case, the predetermined distance can be set at the distance L3 (see FIG. 9B) so that the predetermined distance is the same as in the case in which the preliminary operation is carried out after the state-switching.

It should be understood that the disclosure is not limited to the examples described above and various modifications can be made, and therefore included, within the scope of the disclosure set forth in the claims.

What is claimed is:

1. A recording apparatus, comprising:

a recording unit that performs recording by ejecting liquid onto a medium;

a belt conveyor unit including an upstream-side roller, a downstream-side roller, and an endless conveyor belt that extends around the upstream-side roller and the downstream-side roller and has a belt outer surface, the belt conveyor unit transporting the medium so as to adhere the medium to the belt outer surface, the belt conveyor unit being switchable between a first state in which at least a portion of the belt outer surface is located at a recording position at which the recording unit performs recording and a second state in which the belt outer surface is located more distant from the recording unit than when the belt outer surface is located at the recording position in the first state; and a wiping device that is in contact with the belt outer surface and wipes the belt outer surface, wherein the belt conveyor unit is switched from the second state to the first state after carrying out of a preliminary operation in which the conveyor belt is moved over a predetermined distance in a direction opposite to a normal direction in which the conveyor belt transports the medium.

2. The recording apparatus according to claim 1, wherein the belt conveyor unit is formed so as to move rotatably about a pivot while a rotation shaft of the upstream-side roller serves as the pivot so that the belt conveyor unit may be switched between the first state and the second state.

3. The recording apparatus according to claim 1, wherein the belt conveyor unit is switched from the second state to the first state after the conveyor belt starts moving in the normal direction contiguously after the preliminary operation is carried out.

4. The recording apparatus according to claim 1, wherein the conveyor belt starts moving in the normal direction after the belt conveyor unit is switched from the second state to the first state.

5. The recording apparatus according to claim 1, further comprising a charging device that charges the conveyor belt, wherein the charging device charges the conveyor belt when the conveyor belt moves in the normal direction.

6. The recording apparatus according to claim 1, wherein the preliminary operation is not performed in the case that a stop period of the conveyor belt is less than a predetermined value when the belt conveyor unit is switched from the second state to the first state.

7. The recording apparatus according to claim 1, further comprising:

a drive source that drives the belt conveyor unit; and a load detection device that detects a load applied to the drive source, wherein the conveyor belt is moved over a distance determined in advance in the normal direction before carrying out of the preliminary operation, and the preliminary operation is not performed in the case that the load detected by the load detection device when the conveyor belt is moved is lower than a predetermined value.

8. A recording apparatus, comprising:

a recording unit that performs recording by ejecting liquid onto a medium;

a belt conveyor unit including an upstream-side drive roller, a downstream-side idler roller, and an endless conveyor belt that extends around the upstream-side drive roller and the downstream-side idler roller and has a belt outer surface, the belt conveyor unit transporting the medium so as to adhere the medium to the belt outer surface, the belt conveyor unit being switchable between a first state in which at least a portion of the belt outer surface is located at a recording position at which the recording unit performs recording and a second state in which the belt outer surface is located more distant from the recording unit than when the belt outer surface is located at the recording position in the first state; and a wiping device disposed in the belt conveyor unit, the wiping device being in contact with the belt outer surface and wiping the belt outer surface, wherein the belt conveyor unit is formed so as to move rotatably about a pivot while a drive shaft of the upstream-side drive roller serves as the pivot so that the belt conveyor unit may be switched between the first state and the second state, and the belt conveyor unit is switched from the second state to the first state while the upstream-side drive roller rotates freely relative to the drive shaft.

9. The recording apparatus according to claim 8, wherein when the belt conveyor unit is switched from the second state to the first state, power supplied to a drive source that drives the upstream-side drive roller is switched off.

* * * * *